US008915219B2

(12) United States Patent
Nakamura et al.

(10) Patent No.: US 8,915,219 B2
(45) Date of Patent: Dec. 23, 2014

(54) WORKING MACHINE ENGINE AND WORKING MACHINE USING THE SAME

(75) Inventors: Yuki Nakamura, Numazu (JP); Yasuyuki Sakakibara, Numazu (JP)

(73) Assignee: Makita Corporation, Anjo-shi (JP)

( * ) Notice: Subject to any disclaimer, the term of this patent is extended or adjusted under 35 U.S.C. 154(b) by 408 days.

(21) Appl. No.: 13/150,732

(22) Filed: Jun. 1, 2011

(65) Prior Publication Data

US 2012/0011730 A1 Jan. 19, 2012

(30) Foreign Application Priority Data

Jul. 14, 2010 (JP) ..... 2010-160041

(51) Int. Cl.

| | |
|---|---|
| ***F01P 7/02*** | (2006.01) |
| ***F01P 5/06*** | (2006.01) |
| *F02B 63/02* | (2006.01) |
| *F02B 75/16* | (2006.01) |
| *F01P 5/02* | (2006.01) |

(52) U.S. Cl.

CPC . *F01P 5/06* (2013.01); *F02B 63/02* (2013.01); *F02B 75/16* (2013.01); *F01P 2005/025* (2013.01)

USPC ..... 123/41.11; 30/277.4; 123/41.16

(58) Field of Classification Search

USPC ..... 123/41.11, 41.16; 30/277.4

See application file for complete search history.

(56) References Cited

U.S. PATENT DOCUMENTS

| | | | | |
|---|---|---|---|---|
| 4,702,201 | A * | 10/1987 | Odo et al. | 123/2 |
| 5,950,578 | A * | 9/1999 | Hirano et al. | 123/41.65 |
| 6,161,510 | A * | 12/2000 | Ishikawa et al. | 123/73 AD |
| 6,332,440 | B1 | 12/2001 | Nagai et al. | |
| 6,640,443 | B2 * | 11/2003 | Husges et al. | 30/276 |
| 6,925,970 | B2 * | 8/2005 | Liu et al. | 123/41.69 |
| 6,935,297 | B2 * | 8/2005 | Honda et al. | 123/196 R |
| 7,363,885 | B2 * | 4/2008 | Miyake et al. | 123/41.11 |
| 2003/0079711 | A1 * | 5/2003 | Ito et al. | 123/196 R |
| 2004/0206312 | A1 | 10/2004 | Liu et al. | |
| 2005/0050867 | A1 * | 3/2005 | Taomo et al. | 55/385.3 |
| 2006/0185628 | A1 * | 8/2006 | Akaike et al. | 123/41.65 |
| 2008/0257625 | A1 * | 10/2008 | Stranges | 180/69.1 |
| 2011/0308485 | A1 | 12/2011 | Nakamura et al. | |

FOREIGN PATENT DOCUMENTS

| | | |
|---|---|---|
| EP | 2 397 665 A1 | 12/2011 |
| JP | U-50-83433 | 7/1975 |
| JP | U-58-181985 | 12/1983 |
| JP | A-10-115221 | 5/1998 |

(Continued)

OTHER PUBLICATIONS

Oct. 1, 2013 Extended European Search Report issued in European Patent Application No. 11173716.9.

(Continued)

*Primary Examiner* — Noah Kamen
*Assistant Examiner* — James Kim
(74) *Attorney, Agent, or Firm* — Oliff PLC

(57) ABSTRACT

A working machine engine is provided. The air flowing through the front side cooling air flow passage and the upper side cooling air flow passage which are provided in the front side and the upper side of the casing, respectively, and the air flowing through the auxiliary air flow passage provided in the back side of the casing join together near the opening. By this means, the air flowing through the auxiliary air flow passage can change the direction of the air flowing lengthwise through the front side cooling air flow passage and the upper side cooling air flow passage.

20 Claims, 6 Drawing Sheets

(56) References Cited

FOREIGN PATENT DOCUMENTS

| | | |
|---|---|---|
| JP | A-11-236819 | 8/1999 |
| JP | A-11-336587 | 12/1999 |
| JP | A-2000-161074 | 6/2000 |
| JP | A-2004-324420 | 11/2004 |
| JP | A-2005-337197 | 12/2005 |
| JP | A-2012-002143 | 1/2012 |

OTHER PUBLICATIONS

Jan. 7, 2014 Office Action issued in Japanese Patent Application No. 2010-160041 (with translation).

* cited by examiner

WORKING MACHINE ENGINE AND WORKING MACHINE USING THE SAME

FIELD OF THE INVENTION

The present invention relates to a working machine engine that can be used in a working machine such as a brush cutter, a chain saw, a blower and a cultivator, and a working machine using the same.

BACKGROUND OF THE INVENTION

Conventionally, a working machine engine has been known that has: an engine body including a cylinder block section in which a cylinder is provided, a cylinder head section provided above the cylinder block section, and a crank case section provided below the cylinder block section; a crank shaft that is provided to allow the power transmission shaft of a working machine to be coupled thereto and rotatably supported by the crank case section; a casing that covers the outer surface of the engine body; a fan section that is coupled to the crank shaft and distributes air to cool the engine body by rotation of the crank shaft. A cooling air flow passage that allows cooling air to flow through by the fan section is provided between the engine body and the inner surface of the casing (see Patent Document 1).

There is a demand to improve the versatility of this kind of working machine engines, that is, a demand to be able to apply the same type of working machine engines to different kinds of working machines such as a brush cutter, chain saw, power blower and cultivator. When the power transmission shaft of a working machine is connected to one end of a crank shaft, the method of connecting one end of a crank shaft to the power transmission shaft of a working machine varies depending on the kind of a working machine, for example, whether or not the working machine needs a device such as a clutch for the connection. As a result of this, in order to improve the versatility of a working machine engine, it is required to secure space to connect a device such as a clutch in one end (herein after referred to as "the first end") of the crank shaft to which the power transmission shaft of a working machine is coupled. Therefore, an engine has been proposed in which space is secured in the other end (hereinafter referred to as "second end") opposite to the first end of the crank shaft by coupling an impeller as a blower means and a recoil starter into the second end of the crank shaft.

PRIOR ART DOCUMENT

Patent Document

[Patent Document 1] Japanese Utility Model Application Laid-Open No. SHO58-181985

In the working machine engine in which an impeller is coupled to the second end of the crank shaft, cooling air flows through a cooling air flow passage from the second end to the first end of the crank shaft, and is discharged from the first end. When this working machine engine is applied to a brush cutter, the operator is positioned in one end side of the working machine engine and works, and the cooling air having been heated by the engine is likely to touch the operator.

SUMMARY OF THE INVENTION

It is therefore an object of the present invention to provide a working machine engine with improved versatility, which can prevent cooling air heated by the engine from being discharged toward the operator using a working machine to improve safety, and a working machine using the same.

To solve the foregoing problems, a first aspect of the present invention provides a working machine engine. The working machine engine includes: an engine body having a cylinder block in which a cylinder is provided, a cylinder head provided above the cylinder block and a crank case provided below the cylinder block; a crank shaft that has a first end to which a working machine can be coupled and is rotatably supported by the crank case; a casing that covers an outer surface of the engine body; and a fan section that is coupled to a second end opposite to the first end of the crank shaft and generates flow of cooling air in the engine body by rotation of the crank shaft. A cooling air flow passage is provided between the engine body and the casing to allow the cooling air to flow through from a surface of the engine body facing the second end of the crank shaft to a surface of the engine body facing the first end of the crank shaft. The working machine engine further includes an auxiliary fan section that is coupled to the first end of the crank shaft and generates air flow by rotation of the crank shaft, and an auxiliary fan section that is coupled to the first end of the crank shaft and generates flow of air by rotation of the crank shaft. The auxiliary air flow passage has an outlet in a side surface of the engine body in a direction orthogonal to the crank shaft. The auxiliary air flow section flows air toward the outlet. The cooling air flow passage joins the auxiliary air flow passage.

In a second aspect of the present invention, the working machine engine further includes an intake valve and an exhaust valve open and close an intake port and an exhaust port provided on the cylinder head in the engine body, respectively, and a valve operating mechanism that drives the intake valve and the exhaust valve by torque of the crank shaft. The valve operating mechanism is provided on a surface of the engine body facing the auxiliary air flow passage. In a third aspect of the present invention, the working machine engine further includes an oil tank that is provided below the engine body and stores lubricating oil, and an oil tank cover provided below the oil tank. An oil tank cooling air flow passage that allows air to flow toward the fan section, is provided between the oil tank and the oil tank cover. In a fourth aspect of the present invention, the working machine engine further includes a carburetor connected to the intake port, and a fuel tank that stores fuel. The fuel tank is disposed below the carburetor, and the oil tank cover is integrally formed with the fuel tank.

In a fifth aspect of the present invention, a plurality of protrusions parallel to each other and extending in a direction of air flow through the oil tank cooling air flow passage, are provided on a surface of the oil tank cover facing the oil tank. In a sixth aspect of the present invention, a plurality of protrusions parallel to each other and extending in a direction of air flow through the oil tank cooling air flow passage, are provided on a surface of the oil tank facing the oil tank cover. In a seventh aspect of the present invention, a recoil starter is provided outside the fan section. The fan section is covered with a recoil starter cover covering an exterior of the recoil starter. In an eighth aspect of the present invention, a centrifugal clutch to which a working machine can be coupled, is connected to the first end of the crank shaft. The centrifugal clutch is provided with the auxiliary fan section.

In a ninth aspect of the present invention, the working machine engine according to one of the aspects 1 to 8 is used in a working machine.

In a tenth aspect of the present invention, when the working machine engine is applied to a brush cutter as the working machine according to the ninth aspect, an outlet of the auxiliary air flow passage is provided in the right side of the in the engine body as seen from the second end of the crank shaft.

According to the first aspect of the present invention, the fan section is coupled to the second end of the crank shaft, and the working machine is coupled to the first end of the crank shaft, and therefore it is possible to improve versatility. Then, the cooling air flow passage joins the auxiliary air flow passage, so that the air having flowed through the cooling air flow passage and heated, is mixed with the air flowing through the auxiliary air flow passage and discharged. Consequently, the temperature of the air to be discharged is not high, and therefore it is possible to improve safety. In addition, particularly as a case of a brush cutter, when the operator is positioned in one end side of the engine body, the air can be discharged in the direction in which the operator is not positioned, and therefore it is possible to improve safety.

Moreover, according to the second aspect of the present invention, the components in the valve operating mechanism can be cooled by the air flowing through the auxiliary air flow passage, and therefore it is possible to effectively cool the components in the valve operating mechanism. Moreover, according to the third aspect of the present invention, the oil tank can be cooled by the air flowing through the oil tank cooling air flow passage, and therefore it is possible to prevent the lubricating ability of lubricating oil from deteriorating by heat. In addition, according to the fourth aspect of the present invention, the oil tank cover is integrally formed with the fuel tank, and therefore a mounting structure to mount the oil tank cover under the oil tank is not required. As a result of this, it is possible to reduce the number of components. Moreover, the fuel tank is located alongside the oil tank cover, and therefore can constitute the oil tank cooling air flow passage. As result of this, it is possible to reduce the number of components. Moreover, according to the fifth aspect of the present invention, air flow through the oil tank cooling air flow passage can be rectified. Therefore, it is possible to increase the amount of the air flowing through the oil tank cooling air flow passage and also increase the amount of the cooling air flowing through the cooling air flow passage.

In addition, according to the sixth aspect of the present invention, air flow through the oil tank cooling air flow passage can be rectified. Therefore, it is possible to increase the amount of the air flowing through the oil tank cooling air flow passage and also increase the amount of the cooling air flowing through the cooling air flow passage. Moreover, the area of the lower surface of an oil pan contacting the air flowing through the oil tank cooling air flow passage can be increased, and therefore it is possible to more efficiently cool the oil tank. Moreover, according to the seventh aspect of the present invention, the casing to cover the fan section can be used as the recoil starter cover. And therefore, it is possible to reduce the number of components and the weight. Moreover, according to the eighth aspect of the present invention, the centrifugal clutch can be integrally formed with the auxiliary fan section, and therefore it is possible to reduce the size of the working machine engine and cool the centrifugal clutch.

In addition, according to the ninth aspect of the present invention, when the working machine engine according to one of the first aspect to the eighth aspect is applied to a working machine, the air having flowed through the cooling air flow passage and heated, is mixed with the air flowing through the auxiliary air flow passage and then discharged. Consequently the temperature of the air to be discharged is not high, and therefore it is possible to improve safety. Moreover, according to the tenth aspect of the present invention, when the working machine engine is applied to a brush cutter as the working machine according to the ninth aspect, the air having flowed through the cooling air flow passage and heated, is discharged from the right side of the engine body as seen from the second end of the crank shaft. This prevents the heated air from directly touch the operator of the brush cutter, and therefore it is possible to improve safety.

DETAILED DESCRIPTION OF THE PREFERRED EMBODIMENTS

Figure 1:
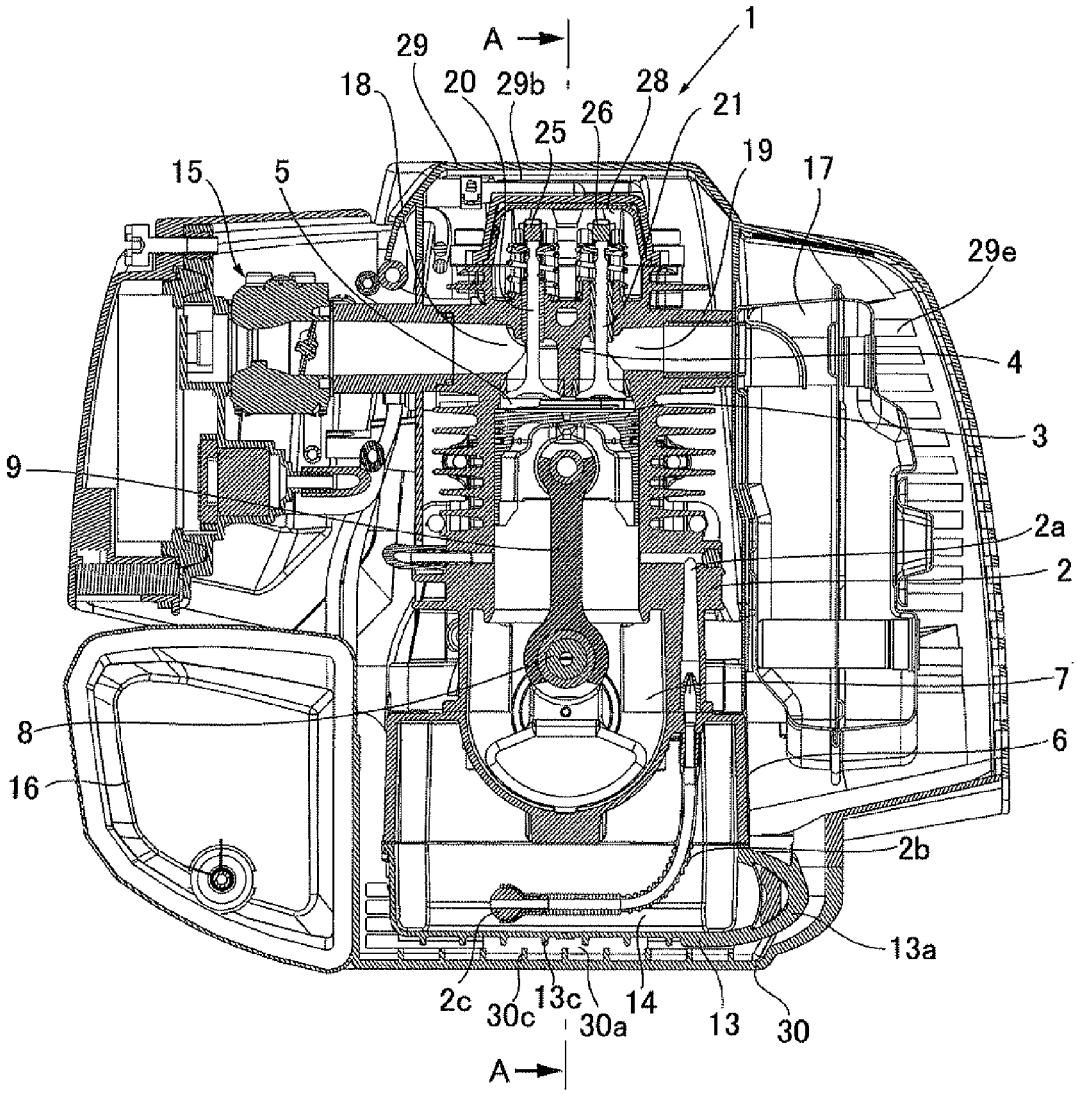
FIG. 1 is across sectional view showing the front surface of a four-stroke engine according to one embodiment of the present invention.
Figure 2:
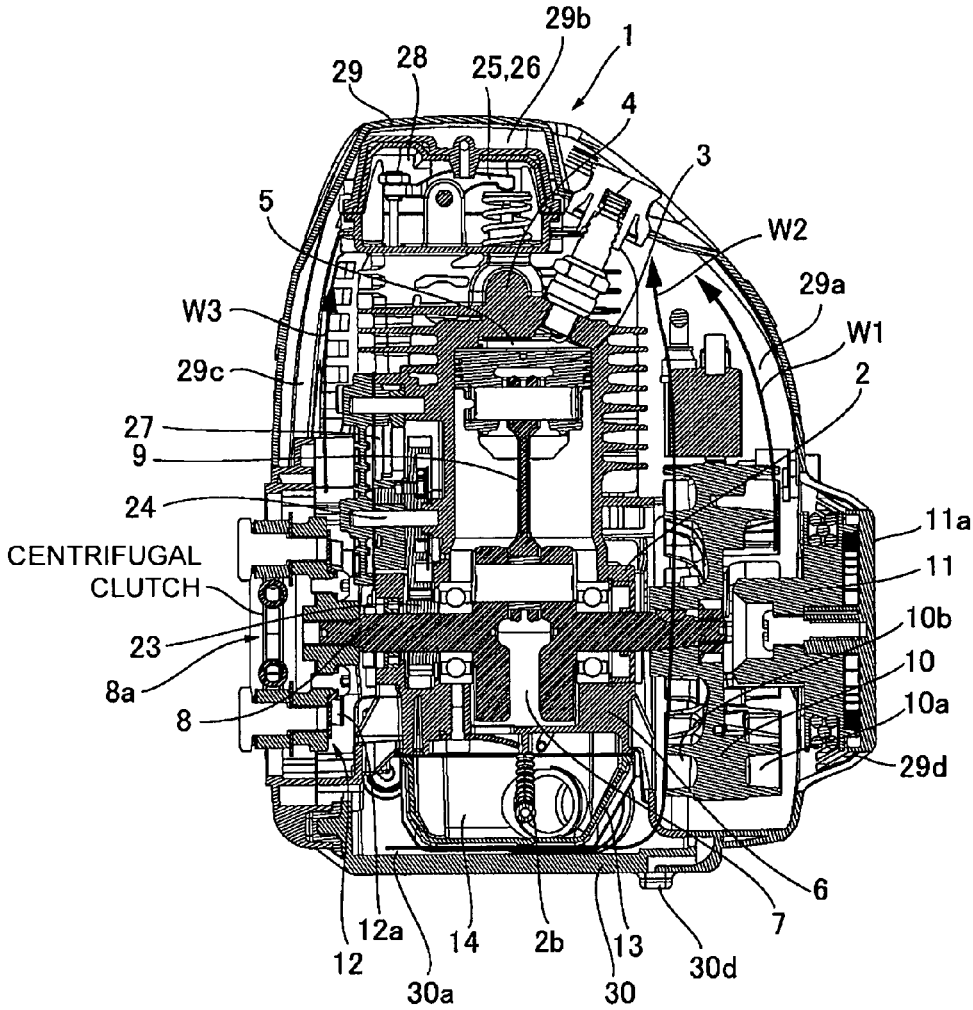
FIG. 2 is a cross sectional view along A-A line of FIG. 1.

FIG. 1 to FIG. 6 show one embodiment of the present invention. Here, with the present embodiment, the top, bottom, right side, left side, front side and back side in FIG. 1 will be described as "upper", "lower", "right", "left", "front" and "back", respectively. The four-stroke engine 1 according to the present invention is used as the source of power of a working machine such as a brush cutter, chain saw, power blower and cultivator. As shown in FIGS. 1 and 2, this four-stroke engine 1 accommodates a piston 3 in a cylinder block 2 such that the piston 3 can move upward and downward. A cylinder head 4 is integrally formed with the upper end part of this cylinder block 2. A combustion chamber 5 is formed by these cylinder block 2 and cylinder head 4, and the upper surface of the piston 3. A crank case 6 is fixed to the lower end part of the cylinder block 2. A crank chamber 7 is formed by the cylinder block 2 and the crank case 6.

A crank shaft 8 is rotatably supported in this crank chamber 7 such that both ends of the crank shaft 8 project forward and backward from the crank chamber 7. This crank shaft 8 is coupled to the piston 3 via a connecting rod 9, and reciprocating motion of the piston 3 is converted into rotational motion of the crank shaft 8 via the connecting rod 9.

A flywheel 10 is coupled to the forward end of the crank shaft 8 to stabilize rotation of the crank shaft 8. A plurality of fan blades 10*a*, as blower means, are provided on the front surface of the flywheel 10, which are apart from each other in the circumferential direction. In addition, a plurality of fan blades 10*b*, as blower means, are provided on the back surface of the flywheel 10, which are apart from each other in the circumferential direction. The plurality of fan blades 10*a* and 10*b* provided on the flywheel 10 generate air flow in the radial direction of the flywheel 10 by rotation of the flywheel 10. In addition, a well-known recoil starter 11 to activate the four-stroke engine 1 is coupled to the forward end of the crank shaft 8 located in the forward part of the flywheel 10.

A shaft coupling part 8*a* that connects and supports the power transmission shaft of a working machine (not shown), is provided in the backward end of the crankshaft 8. For example, a centrifugal clutch is coupled to this shaft connecting part 8*a*. Meanwhile, a small auxiliary impeller 12 as an auxiliary blower means that rotates with the crank shaft 8 to distribute air in the radial direction of the crank shaft 8, is coupled to the front part of the shaft coupling part 8*a* in the crank shaft 8. A plurality of impeller blades 12*a* are provided on the front surface of the auxiliary impeller 12, which are apart from each other in the circumferential direction. Each of the plurality of impeller blades 12*a* is formed in the auxiliary impeller 12 by cutting and raising part of a circular metal plate. These impeller blades 12*a* in the auxiliary impeller 12 generate air flow by rotation of the auxiliary impeller 12. Here, when the centrifugal clutch is coupled to the shaft coupling part 8*a*, the auxiliary impeller 12 is integrally formed with the centrifugal clutch, and therefore it is possible to reduce the size of the four-stroke engine 1 and cool the centrifugal clutch.

An oil pan 13 is fixed to the lower surface of the crank case 6, and an oil tank 14 is formed by the crank case 6 and the oil pan 13. This oil tank 14 is space sealed with the crank case 6 and the oil pan 13 as shown in the figure, and stores lubricating oil to lube each driving component in the four-stroke engine 1 in the space. This prevents lubricating oil from scattering from the oil tank 14 even if a portable working machine such as a brush cutter overturns or turns sideways in use. In addition, the oil pan 13 is made of a metal material, and has an oil feeding pipe 13*a* extending obliquely upward from the right to feed lubricating oil to the tank 14. An opening formed in the end of the oil feeding pipe 13*a* is closed and opened by a lubricating oil cap 13*b*. In addition, on the lower surface of the oil pan 13, a plurality of protrusions 13*c* parallel to each other and extending lengthwise, are arranged apart from each other in the horizontal direction.

A carburetor 15 is provided on the left side of the part (cylinder head 4) above the cylinder block 2. The carburetor 15 mixes the fuel introduced from a fuel tank 16 with the air having passed through an air cleaner to create air-fuel mixture. The carburetor 15 is a diaphragm carburetor that can be used in all directions taking into account a case in which the working machine may overturn or turn sideways in use. Moreover, the carburetor 15 is connected with the fuel tank 16 through a suction pipe and a return pipe (not shown).

Figure 5:
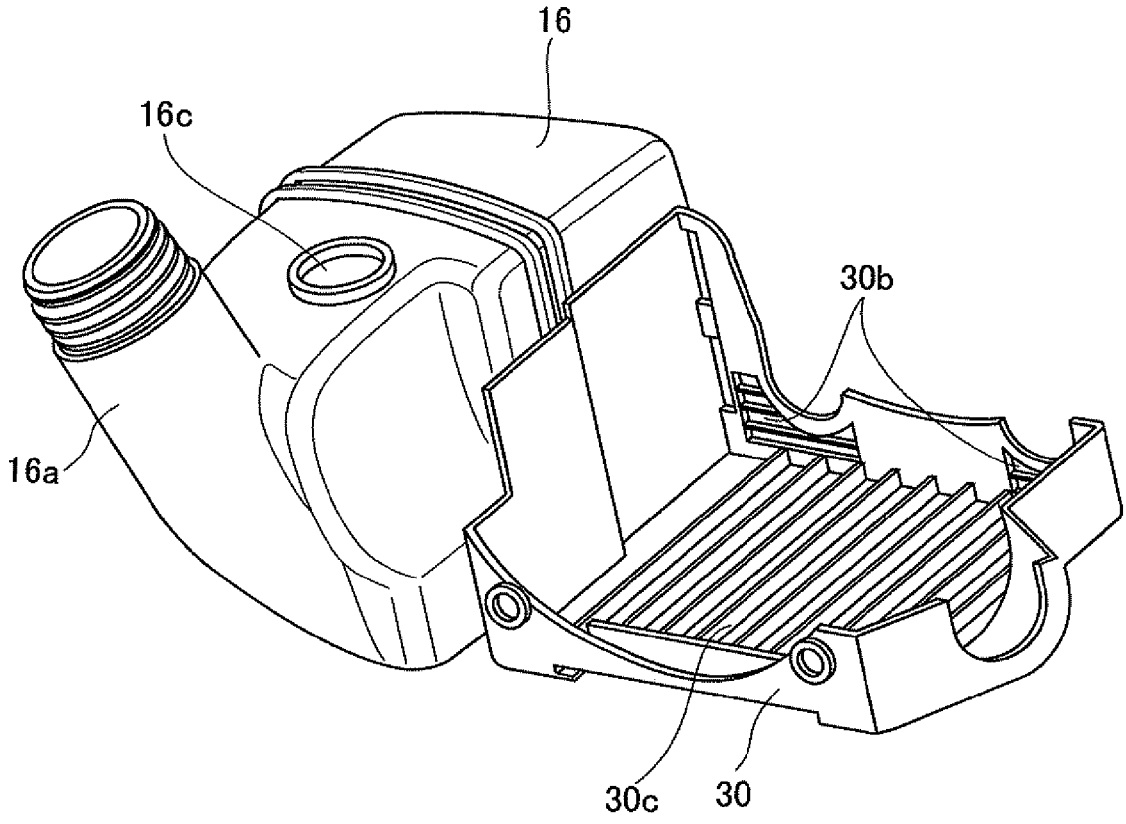
FIG. 5 is a perspective view showing a fuel tank and an oil tank cover.
Figure 6:
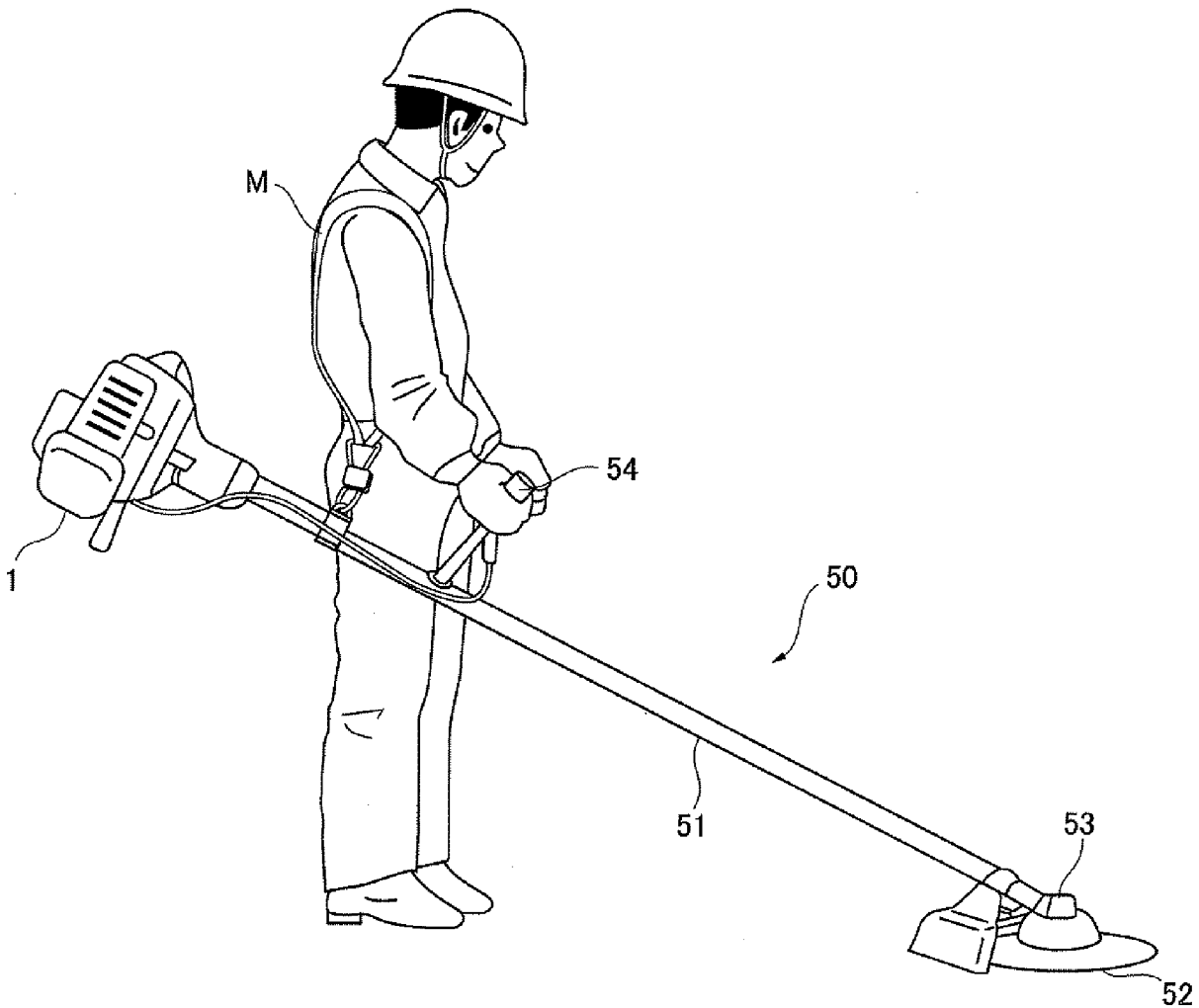
FIG. 6 shows a state where a brush cutter to which the four-stroke engine is applied, is used.

The Fuel tank 16 is made of a synthetic resin material and provided in the space located on the left side of the crank chamber 7 and the oil tank 14 and below the carburetor 15. A fuel feeding pipe 16*a* extending obliquely upward is provided in the front part of the fuel tank 16. An opening formed in the end of the fuel feeding pipe 16*a* is closed and opened by a fuel cap 16*b*. In addition, as shown in FIG. 5, a cap mounting hole 16*c* is formed behind the fuel feeding pipe 16*a* to face the carburetor 15. A cap (not shown) is mounted on this cap mounting hole 16*c* while the suction pipe and the return pipe are pressed and fitted to penetrate the cap.

An exhaust muffler 17 to discharge the exhaust gas created in the combustion chamber 5 is provided on the right side of the part (cylinder head 4) above the cylinder block 2. The Oil feeding pipe 13*a* to feed oil to the oil tank 14 is disposed below the exhaust muffler 17.

Figure 3:
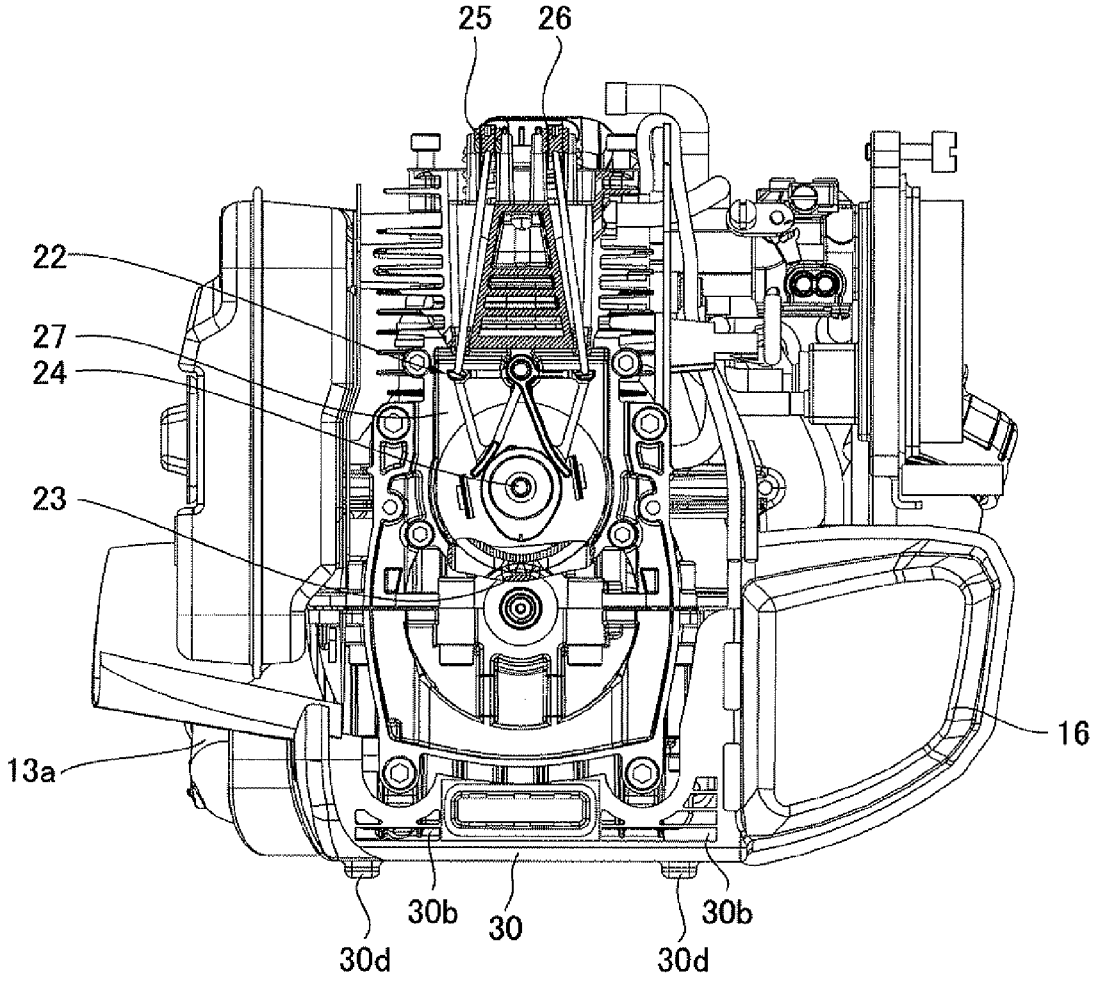
FIG. 3 is a partial cross sectional view showing the back surface of the four-stroke engine.
Figure 4:
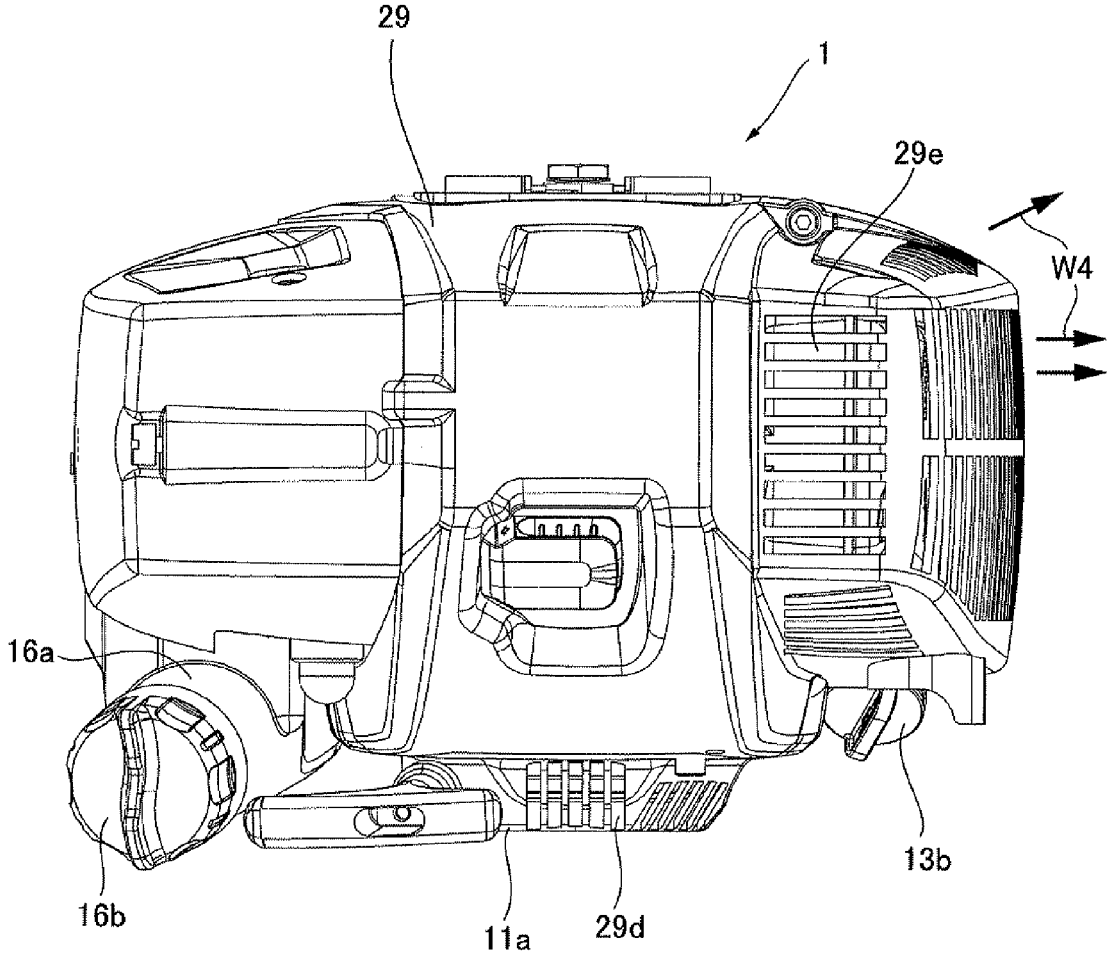
FIG. 4 is a plan view showing the four-stroke engine.

An intake port 18 to introduce the air-fuel mixture created in the carburetor 15 into the combustion chamber 5 and an exhaust port 19 to introduce the exhaust gas created in the combustion chamber 5 into the exhaust muffler 17, are formed in the cylinder head 4. In addition, an intake valve 20 to open and close the intake port 18 with respect to the combustion chamber 5 and an exhaust valve 21 to open and close the combustion chamber 5 with respect to the exhaust port 19, are provided in the cylinder head 4. These intake valve 20 and exhaust valve 21 open and close by means of a valve operating mechanism 22 for an overhead valve as shown in FIG. 3.

The valve operating mechanism 22 has a crank shaft gear 23, a cam shaft 24, and locker arms 25 and 26, as main components. The crank shaft gear 23 and the can shaft 24 are provided in a side chamber 27 formed along the back surfaces of the cylinder block 2 and the crank case 6, and the locker arms 25 and 26 are provided in a valve operating chamber 28 formed above the cylinder head 4. The torque of the crank shaft 8 is transmitted to the intake valve 20 and the exhaust valve 21 through the crank shaft gear 23, the cam shaft 24 and the locker arms 25 and 26 to open and close the intake port 18 and the exhaust port 19.

In addition, the front surface, the upper surface and the back surface of this four-stroke engine 1 are covered with a casing 29, and the lower surface is covered with an engine base 30 as an oil tank cover.

A front side cooling air flow passage 29*a*, an upper side cooling air flow passage 29*b* and an auxiliary air flow passage 29*c* are provided in the front side, the upper side and the back side of the casing 29, respectively.

The front side cooling air flow passage 29*a* is formed to extend in the vertical direction between the casing 29 and the front surfaces of the crank case 6, the cylinder block 2, the cylinder head 4, the valve operating chamber 28 and the exhaust muffler 17. The flywheel 10 is disposed in the lower part of the front side cooling air flow passage 29*a*. The recoil starter 11 is provided in the front of the flywheel 10, and the exterior of the flywheel 10 is covered with a recoil starter cover 11*a* covering the exterior of the recoil starter 11. A front side air inlet 29*d* is provided in the lower part of the front side cooling air flow passage 29*a* and communicates with the front side cooling air flow passage 29*a*.

The upper side cooling air flow passage 29*b* is formed to extend lengthwise above the cylinder head 4 and the valve operating chamber 28.

Moreover, the auxiliary air flow passage 29*c* is formed to extend in the vertical direction between the casing 29 and the back surfaces of the cylinder block 2 except for the shaft coupling part 8*a*, the side chamber 27, the valve operating chamber 28 and the exhaust muffler 17. In the auxiliary air flow passage 29*c*, an opening 29*e* is provided on the surface in the right side and the auxiliary impeller 12 is provided in the lower part.

As shown in FIG. 5, the left side surface of the engine base 30 is coupled to the fuel tank 16, so that the engine base 30 is integrally formed with the fuel tank 16. In addition, the engine base 30 has a structure in which its front surface is clamped, with the casing 29, to the oil pan 13 with a screw, so that the engine base 30 is fixed. This allows the fuel tank 16 to be fixed to the oil pan 13. The engine base 30 is arranged apart from the lower surface of the oil pan 13, and a bottom side air flow passage 30*a* for cooling the oil tank is formed between the engine base 30 and the lower surface of the oil pan 13. The front surface of the bottom side air flow passage 30*a* communicates with the lower end of the front side cooling air flow passage 29*a*, and the back surface of the bottom side air flow passage 30*a* communicates with the lower end of the auxiliary air flow passage 29*c*. In addition, back side air inlets 30*b* are provided on the back surface of the engine base 30, and the auxiliary air flow passage 29*c*, the bottom side air flow passage 30*a* and the front side cooling air flow passage 29*a* communicate with the back side air inlets 30*b*. The bottom side air flow passage 30*a* is closed at the right edge. On the upper surface of the engine base 30, a plurality of protrusions 30*c* parallel to each other and extending lengthwise, are arranged apart from each other in the horizontal direction. In addition, a pair of left and right legs 30*d* projecting downward, is provided in the front portion of the lower surface of the engine base 30.

Here, circulation of lubricating oil stored in the oil tank 14 will be described. A communicating path 2*a* is formed between the oil tank 14 and the crank chamber 7. A flexible pipe 2*b* is connected to the opening in the communicating path 2*a* in the oil tank 14 side. The oil tank 14 communicates with the crank chamber 7 through the communicating path 2*a* according to the movement of the piston 3. Lubricating oil in the oil tank 14 is introduced into the crank chamber 7, the side chamber 27 and the valve operating chamber 28 by means of a change in the pressure in the crank chamber 7, and returns to the oil tank 14 after lubing each driving component. A weight 2*c* is provided on the tip of the pipe 2*b* to allow the pipe 2*b* to follow a change in the liquid level of lubricating oil. By this means, even if the four-stroke engine 1 is tilted, the pipe 2*b* can reliably inhale the lubricating oil in the oil tank 14.

Upon driving the above-described working machine engine, the flywheel 10 rotates with the crank shaft 8, and air flows from the front side air inlet 29*d* into the front side cooling air flow passage 29*a* due to the action of the fan blades 10*a* provided on the front surface of flywheel 10. As indicated by an arrow W1 in FIG. 2, the air flowing into the front side cooling air flow passage 29*a* cools the cylinder head 4 and the operating valve chamber 28.

Meanwhile, air flows from the back side air inlets 30*b* into the bottom side air flow passage 30*a* due to the action of the fan blades 10*b* provided on the back surface of the flywheel 10. The air flowing into the bottom side air flow passage 30*a* cools the oil tank 14, the crank case 6 and the lower part of the cylinder block 2 as indicted by an arrow W2 in FIG. 2, and then flows into the front side cooling air flow passage 29*a*.

The air flowing through the bottom side air flow passage 30*a* is rectified by each protrusion 13*c* provided on the lower surface of the oil pan 13 and each protrusion 30*c* provided on the upper surface of the engine base 30. The heat transfer area of the oil pan 13 is enlarged by each protrusion 13*c*, so that heat exchange between the air flowing through the bottom side air flow passage 30*a* and the lubricating oil in the oil tank 14 is accelerated.

Meanwhile, air flows from the back side air inlets 30*b* into the auxiliary air flow passage 29*c* due to the action of the auxiliary impeller 12 rotating with the crank shaft 8. As indicated by an arrow W3 in FIG. 2, the air flowing into the auxiliary air flow passage 29*c* cools the side chamber 27 and the valve operating chamber 28.

Incidentally, the inner surface of the casing 29 in the front side is formed to have a curved shape curving upward and backward. Therefore, the air flowing through the front side cooling air flow passage 29*a* is guided backward as flowing upward along the inner surface of the casing 29, and then flows smoothly into the upper side cooling air flow passage 29*b*.

Meanwhile, the inner surface of the casing 29 in the back side is formed to have a curved shape curving upward and forward. Therefore, the air flowing through the auxiliary air flow passage 29*c* is guided forward as flowing upward along the inner surface of the casing 29, and then discharged from the opening 29*e* provided on the right side surface.

Cooling air flowing through the upper side cooling air flow passage 29*b* is guided while cooling the cylinder head 4 and flows into the auxiliary air flow passage 29*c*. The cooling air having flowed into the auxiliary air flow passage 29*c* is mixed with the air flowing through the auxiliary air flow passage 29*c* and discharged from the opening 29*e*. At this time, the air is discharged to the right as indicated by an arrow W4 in FIG. 4, because the air flowing through the upper side cooling air flow passage 29*b* and the air flowing through the auxiliary air flow passage 29*c* join together as described above.

The air flowing through the front side cooling air flow passage 29*a* and the upper side cooling air flow passage 29*b* cools the oil tank 14, the crank case 6, the cylinder block 2, the cylinder head 4 and the valve operating chamber 28, and therefore increases in the temperature. Meanwhile, the temperature of the air flowing through the auxiliary air flow passage 29*c* is lower than that of the air flowing through the front side cooling air flow passage 29*a* and the upper side cooling air flow passage 29*b*, because the auxiliary air flow passage 29*c* has the shorter entire length than the front side cooling air flow passage 29*a* and the upper side cooling air flow passage 29*b* and cools the side chamber 27 whose temperature is lower than the cylinder block 2. Therefore, the air at a high temperature having flowed through the front side cooling air flow passage 29*a* and the upper side cooling air flow passage 29*b* is mixed with the air at a relatively low temperature flowing through the auxiliary air flow passage 29*c*, and therefore it is possible to prevent air at a high temperature from being directly discharged from the opening 29*e* (outlet).

Next, a case will be explained where the four-stroke engine 1 is provided in a brush cutter 50 as an example of working machines.

This brush cutter 50 has the four-stroke engine 1, an operating rod 51 whose one end is connected to the back surface of the four-stroke engine 1 and a circular saw 52 rotatably mounted to the other end of the operating rod 51.

A power transmission shaft (not shown) is rotatably mounted in the operating rod 51. The shaft coupling part 8*a* in the four-stroke engine 1 is coupled to one end of the power transmission shaft and the circular saw 52 is coupled to the other end via a gear head 53. A handle 54 is provided near the intermediate part of the operating rod 51. A control lever (not shown) to control operation of the four-stroke engine 1 is provided in the handle 54.

To do work using the brush cutter 50 configured as described above, first the four-stroke engine 1 is driven and the control lever is operated, and therefore the torque of the four-stroke engine 1 is transmitted to the circular saw 52 via the power transmission shaft to rotate the circular saw 52. Then, an operator M holds the handle 54 by hand and moves the circular saw 52 to cut and other plants.

At this time, the four-stroke engine 1 is located behind the operator M a little to the right and its back surface faces the operator M. Here, the air in the four-stroke engine 1 is discharged from the opening 29*e* toward the right hand of the four-stroke engine 1, and therefore does not directly touch the operator M. In addition, the air at a high temperature having flowed through the cooling air flow passage is mixed with the air at a low temperature flowing through the auxiliary air flow passage. This prevents the temperature of the air to be discharged from the opening 29*e* from being high, and therefore it is possible to improve safety.

As described above, in the working machine engine according to the present embodiment, the air flowing through the front side cooling air flow passage 29*a* and the upper side cooling air flow passage 29*b* which are provided in the front side and the upper side of the casing 29, respectively, and the air flowing through the auxiliary air flow passage 29*c* provided in the back side of the casing 29 join together near the opening 29*e*, and the mixed air is discharged from the opening 29*e* to the right. By this means, the air having flowed through the front side cooling air flow passage 29*a* and the upper side cooling air flow passage 29*b* and heated, is mixed with the air flowing through the auxiliary air flow passage 29*c* and discharged from the opening 29*e*. As a result of this, the temperature of the air to be discharged is not high, and therefore it is possible to improve safety. In addition, the air flowing through the auxiliary air flow passage 29*c* can change the direction of the air flowing lengthwise through the front side cooling air flow passage 29*a* and the upper side cooling air flow passage 29*b*, and therefore, when the four-stroke engine 1 is applied to the brush cutter 50, the air is discharged to the right where the operator M is not positioned to improve safety. Also, this four-stroke engine 1 can be applied to various working machines, and therefore improve the versatility.

Moreover, components such as the crank shaft gear 23 and the cam shaft 24 constituting the valve operating mechanism 22 are arranged in the side chamber 27 provided behind the cylinder block 2 and the crank case 6. By this means, the components such as the crank shaft gear 23 and the cam shaft 24 constituting the valve operating mechanism 22 can be cooled with the air flowing through the auxiliary air flow passage 29*c* whose temperature is lower than the air flowing through the front side cooling air flow passage 29*a* and the upper side cooling air flow passage 29*b*, and therefore it is possible to improve the efficiency of cooling.

In addition, the bottom side air flow passage 30*a* is provided between the oil tank 14 and the engine base 30. By this means, the air flowing through the bottom side air flow passage 30*a* can cool the lubricating oil in the oil tank 14, and therefore, it is possible to prevent the lubricating ability of lubricating oil from deteriorating by heat.

Moreover, the fuel tank 16 is disposed in the space below the carburetor 15 and integrally formed with the engine base 30. By this means, the fuel tank 16 does not need to be disposed below the oil tank 14, and therefore it is possible to reduce the dimension of the engine body in the vertical direction. In addition, the engine base 30 is integrally formed with the fuel tank 16, and therefore a mounting structure to mount the engine base 30 under the oil tank 14. As a result of this, it is possible to reduce the size in the vertical direction and the number of components, as compared to a case in which the mounting structure is provided.

Moreover, a plurality of protrusions 30*c* parallel to each other and extending along the bottom side air flow passage 30*a* are provided on the upper surface (the surface facing the oil tank 14) of the engine base 30. By this means, the air flow through the bottom side air flow passage 30*a* can be rectified, and therefore, it is possible to increase the amount of air flow through the bottom side air flow passage 30*a* and efficiently cool the four-stroke engine 1.

Meanwhile, a plurality of protrusions 30*c* parallel to each other and extending along the bottom side air flow passage 30*a* are provided on the lower surface (the surface facing the engine base 30) of the oil pan 13. By this means, the air flow through the bottom side air flow passage 30*a* can be rectified, and therefore it is possible to increase the amount of air flowing through the bottom side air flow passage 30*a*. In addition, the area of the lower surface of the oil pan 13 contacting the air flowing through the bottom side air flow passage 30*a* can be increased, and therefore it is possible to improve the efficiency of cooling the lubricating oil in the oil tank 14.

Moreover, the legs 30*d* are provided on the lower surface of the engine base 30. By this means, when a working machine using the four-stroke engine 1 is placed on the ground, the legs 30 contact the ground, and therefore it is possible to stably place the working machine even if the ground is not flat and rough.

In addition, the recoil starter 11 is provided outside the flywheel 10, and the flywheel 10 is covered with the recoil starter cover 11*a* covering the exterior of the recoil starter 11. By this means, the recoil starter cover 11*a* can also be used as the casing to cover the flywheel 10, and therefore it is possible to reduce the number of components and the weight.

In addition, the oil feeding pipe 13*a* to feed oil to the oil tank 14 is disposed on the right side of the oil tank 14 below the exhaust muffler 17. By this means, the oil feeding pipe 13*a* can be disposed in unused space, so that it is possible to reduce the size of the four-stroke engine 1.

In addition, when the four-stroke engine 1 is used in the brush cutter 50, it is possible to prevent air at a high temperature from touching the operator M to improve safety.

Here, although with the embodiment, the brush cutter 50 has been shown as a working machine to which the four-stroke engine 1 is applied, the present invention is not limited to this. For example, working machines include all machines such as a chain saw and a power blower, which are connected to the crank shaft 8 and operate by rotation of the crank shaft 8.

In addition, although with the embodiment, a configuration has been explained where the auxiliary impeller 12 as an auxiliary blower means is applied to the four-stroke engine 1 as a working machine engine, it is possible to produce the same effect by applying the auxiliary impeller 12 as an auxiliary blower means to a two-stroke engine.

Moreover, although with the embodiment, the vertical four-stroke engine 1 has been shown in which the cylinder head 4 is located above the cylinder block 2 and the clunk case 6 is located below the cylinder block 2, the present invention is not limited to this. For example, a horizontal four-stroke engine is possible in which the cylinder head 4 is located in one side of the cylinder block 2 and the crank case 6 is located in the other side of the cylinder block 2 in the horizontal direction.

Moreover, although with the embodiment, a configuration has been adopted in which the flywheel 10 having the fan blades 10*a* and 10*b* on both sides, as blower means, is coupled to the crank shaft 8, the present invention is not limited to this. Another configuration is possible where, for example, a dedicated impeller having the blades on both sides is coupled with the crank shaft 8 as long as it is possible to flow air by rotation of the crank shaft 8.

Furthermore, although with the embodiment, a configuration has been adopted in which the fuel tank 16 is integrally formed with the engine base 30 using synthetic resin, the present invention is not limited to this. The fuel tank 16 may be integrally formed with the engine base 30 by, for example, fixing the engine base 30 to the fuel tank 16 by means of adhesion, screw clamp and so forth. In addition, the fuel tank 16 and the engine base 30 may be made of different materials, such as metal and synthetic resin, respectively.

Moreover, with the present embodiment, a configuration has been adopted in which the pair of left and right legs 30*d* is provided on the front side of the lower surface of the engine base 30, taking into account that the power transmission shaft in the brush cutter 50 is coupled to the back side of the lower surface of the engine base 30, but the present invention is not limited to this. The legs 30*d* are not limited to a pair of left and right legs on the front side of the lower surface of the engine base 30, and for example, the four-stroke engine 1 may be placed on the ground by providing the legs 30*d* on the four corners in the lower surface of the engine base 30.

Moreover, the shape, arrangement and so forth of each component of the combustion system and the driving system, such as the carburetor 15, the piston 3 and the crank shaft 8, are merely examples, and the present invention is not limited to the configuration of the embodiment.

What is claimed is:

1. A working machine engine comprising:

an engine body having a cylinder block in which a cylinder is provided, a cylinder head provided above the cylinder block and a crank case provided below the cylinder block;

a crank shaft that has a first end to which a working machine can be coupled and is rotatably supported by the crank case;

a casing that covers an outer surface of the engine body;

a fan section that is coupled to a second end opposite to the first end of the crank shaft and generates flow of cooling air in the engine body by rotation of the crank shaft;

a cooling air flow passage that is provided between the engine body and the casing to allow the cooling air having passed through the fan section to flow through from a surface of the engine body facing the second end of the crank shaft to a surface of the engine body facing the first end of the crank shaft, the first end of the crank shaft being located in an operator side;

an auxiliary fan section that is coupled to the first end of the crank shaft and generates flow of air by rotation of the crank shaft, the auxiliary fan section being smaller in size than the fan section;

a centrifugal clutch to which the working machine can be coupled, the centrifugal clutch being connected to the first end of the crank shaft; and an auxiliary air flow passage configured to allow the air having passed through the auxiliary fan section, the auxiliary air flow passage being provided between the casing and the surface of the engine body facing the first end of the crank shaft;

wherein the auxiliary air flow passage has an outlet in a side surface of the engine body in a direction orthogonal to the crank shaft;

the auxiliary air flow section flows air toward the outlet; and the cooling air flow passage joins the auxiliary air flow passage.

2. The working engine machine engine according to claim 1, further comprising:

an intake valve and an exhaust valve open and close an intake port and an exhaust port provided on the cylinder head in the engine body, respectively; and a valve operating mechanism that drives the intake valve and the exhaust valve by torque of the crank shaft, wherein the valve operating mechanism is provided on a surface of the engine body facing the auxiliary air flow passage.

3. The working machine engine according to claim 1, further comprising:

an oil tank that is provided below the engine body and stores lubricating oil; and an oil tank cover provided below the oil tank, wherein an oil tank cooling air flow passage that allows air to flow toward the fan section, is provided between the oil tank and the oil tank cover.

4. The working machine engine according to claim 2, further comprising:

an oil tank that is provided below the engine body and stores lubricating oil; and an oil tank cover provided below the oil tank, wherein an oil tank cooling air flow passage that allows air to flow toward the fan section, is provided between the oil tank and the oil tank cover.

5. The working machine engine according to claim 3, further comprising:

a carburetor connected to the intake port; and a fuel tank that stores fuel, wherein:

the fuel tank is disposed below the carburetor; and the oil tank cover is integrally formed with the fuel tank.

6. The working machine engine according to claim 4, further comprising:

a carburetor connected to the intake port; and a fuel tank that stores fuel, wherein:

the fuel tank is disposed below the carburetor; and the oil tank cover is integrally formed with the fuel tank.

7. The working machine engine according to claim 3, wherein a plurality of protrusions parallel to each other and extending in a direction of air flow through the oil tank cooling air flow passage, are provided on a surface of the oil tank cover facing the oil tank.

8. The working machine engine according to claim 4, wherein a plurality of protrusions parallel to each other and extending in a direction of air flow through the oil tank cooling air flow passage, are provided on a surface of the oil tank cover facing the oil tank.

9. The working machine engine according to claim 3, wherein a plurality of protrusions parallel to each other and extending in a direction of air flow through the oil tank cooling air flow passage, are provided on a surface of the oil tank facing the oil tank cover.

10. The working machine engine according to claim 4, wherein a plurality of protrusions parallel to each other and extending in a direction of air flow through the oil tank cooling air flow passage, are provided on a surface of the oil tank facing the oil tank cover.

11. The working machine engine according to claim 5, wherein a plurality of protrusions parallel to each other and extending in a direction of air flow through the oil tank cooling air flow passage, are provided on a surface of the oil tank facing the oil tank cover.

12. The working machine engine according to claim 6, wherein a plurality of protrusions parallel to each other and extending in a direction of air flow through the oil tank cooling air flow passage, are provided on a surface of the oil tank facing the oil tank cover.

13. The working machine engine according to claim 1, wherein:

a recoil starter is provided outside the fan section; and the fan section is covered with a recoil starter cover covering an exterior of the recoil starter.

14. The working machine engine according to claim 2, wherein:

a recoil starter is provided outside the fan section; and the fan section is covered with a recoil starter cover covering an exterior of the recoil starter.

15. The working machine engine according to claim 1, wherein:

the centrifugal clutch is provided with the auxiliary fan section.

16. The working machine engine according to claim 2, wherein:

the centrifugal clutch is provided with the auxiliary fan section.

17. A working machine that uses a working machine engine according to claim 1.

18. A working machine that uses a working machine engine according to claim 2.

19. The working machine according to claim 17, used as a brush cutter, wherein an outlet of the auxiliary air flow passage is provided in a right side of the engine body as seen from the second end of the crank shaft.

20. The working machine according to claim 18, used as a brush cutter, wherein an outlet of the auxiliary air flow passage is provided in a right side of the engine body as seen from the second end of the crank shaft.

* * * * *